US006644583B2

(12) United States Patent
Schmidt

(10) Patent No.: US 6,644,583 B2
(45) Date of Patent: Nov. 11, 2003

(54) WIRE ROPE TENSIONING DEVICE

(76) Inventor: John W. Schmidt, 220 Ave. B, La Marque, TX (US) 77568

( * ) Notice: Subject to any disclaimer, the term of this patent is extended or adjusted under 35 U.S.C. 154(b) by 0 days.

(21) Appl. No.: 10/047,297

(22) Filed: Jan. 14, 2002

(65) Prior Publication Data

US 2003/0132335 A1 Jul. 17, 2003

(51) Int. Cl.[7] ..... B65H 59/22
(52) U.S. Cl. ..... 242/419.4
(58) Field of Search ..... 242/419.4, 381.1, 242/381.3, 396.5, 149, 129.8; 188/65.1, 65.2; 226/195

(56) References Cited

U.S. PATENT DOCUMENTS

| | | | | | |
|---|---|---|---|---|---|
| 226,946 | A | * | 4/1880 | Whiteman | 242/149 |
| 326,961 | A | * | 9/1885 | Engelke | 188/65.1 |
| 2,394,381 | A | * | 2/1946 | Hoern | 242/419.4 |
| 2,993,659 | A | * | 7/1961 | Hohnson | 242/419.4 |
| 3,379,456 | A | * | 4/1968 | Bogie | 188/65.1 |
| 3,881,647 | A | | 5/1975 | Wolfe | |
| 4,023,744 | A | | 5/1977 | Shutt | |
| 4,227,678 | A | | 10/1980 | Laky | |
| 4,448,281 | A | * | 5/1984 | Adams | 188/65.2 |
| 4,603,755 | A | * | 8/1986 | Meschke | 188/65.2 |
| 4,842,219 | A | * | 6/1989 | Jakubowski et al. | 188/65.1 |
| 5,009,353 | A | | 4/1991 | Alquist | |
| 5,368,212 | A | | 11/1994 | Koch | |

FOREIGN PATENT DOCUMENTS

| | | | | |
|---|---|---|---|---|
| JP | 55-61567 | * | 5/1980 | 242/149 |

* cited by examiner

*Primary Examiner*—John M. Jillions
(74) *Attorney, Agent, or Firm*—Karen A. Rex

(57) ABSTRACT

A tensioning device for providing tension to a length of running cable or line (e.g., wire rope) as it is being wound onto a drum. The tensioning device has a tubular housing in two longitudinal halves, the tubular housing halves hingeably joined along one set of adjacent edges by a hinge means and closeable along the second set of adjacent edges by a clamp means. A removable inner sleeve for receiving and compressing stock in two longitudinal halves, each sleeve half closely received in and lines the interior surface of each tubular housing half. The inner sleeve contains an axial bore equally along its length between the two sleeve halves. The combination of the hinge and clamp means closes the housing halves, compressing the inner sleeves. Anchor rings are mounted on the housing for fixing the device against movement.

18 Claims, 3 Drawing Sheets

WIRE ROPE TENSIONING DEVICE

FIELD OF THE INVENTION

The present invention is in the field of apparatuses for applying a longitudinal stress on a running material of indefinite length. More specifically, the present invention relates to a tension control device associated with a cable drum, the device for applying a clamping drag on a running wire rope, cable or line being wound onto the drum.

BACKGROUND OF THE INVENTION

In the operation of a crane, wire rope or cable wound on hoist drums is used in the lifting of heavy loads, and periodically must be replaced. To insure proper installation of the wire rope or cable, the rope or cable must be tight and tracking properly on the hoist drum. Usually, this is done utilizing manually operated tensioning devices. Further, the boom and/or cable needs to be extended and a load placed on the block in order to assure the cable is tight and tracking properly on the hoist drum.

Various tensioning devices have been used to apply tension to cable to be installed. Included among these are Alquist, U.S. Pat. No. 5,009,353 which describes a device attached to a wire cable to maintain tension on the wire for proper spooling of the cable on a winch drum. Another example of a wire tensioning device is Laky, U.S. Pat. No. 4,227,678. Laky discloses a device in which the cable is wound through the gear train to the traction roller which rubs against the cable as it passes in and out of the hoist. Still another example is Wolfe, U.S. Pat. No. 3,881,647 disclosing an anti-slack device for maintaining constant tension of wire ropes while being unreeled or re-reeled.

Further, Shutt, U.S. Pat. No. 4,023,744 discloses a device for maintaining tension in a cable while winding on or off a power driven cable drum. Koch, U.S. Pat. No. 5,368,212 discloses a device for maintaining tension in a cable while winding on or off a power driven cable drum while fed in a predetermined direction to the automatic cable processing machine.

Although theses devices may be useful each for its intended purpose, it would be beneficial to have an alternative device that does not have moving parts. Those apparatuses comprise tensioning devices that have moving parts, and even include drive motors.

SUMMARY OF THE INVENTION

The present invention is a device for providing tension to running stock, cable or line (e.g., wire rope) as it is being wound onto a drum. More specifically, the present wire rope tensioning device provides a clamping drag on a length of running stock, cable or line as it is being wound onto the drum. The present device has no moving parts and its preferred use is to tension new cable or wire rope as it is being initially wound onto a drum.

The present wire rope tensioning device comprises a tubular housing in two longitudinal halves. Installed inside the tubular housing is a removable inner sleeve, also in two halves. The each inner sleeve half lines the inside side surface of a tubular housing half. The sleeve has an axial bore passing through it, centered along the axis of the inner sleeve. The axial bore receives a length of the cable or line to be tensioned. A clamp means provides for clamping the housing halves and sleeve around a length of cable or line received in the axial sleeve bore to squeeze the length of cable and impart a clamping drag on the cable or line as it runs through the device while being wound onto the drum.

The tubular housing is comprised an open cylinder of two separate longitudinal halves. The tubular housing is constructed of a material suitable for its application, such as steel or other metal or appropriate material. The tubular housing halves have a first set of adjacent edges and a second set of adjacent edges. A means for joining the housing halves together is disposed along each set of adjacent edges. The inner diameter of the tubular housing ranges from about 1 inch to about 2 inches. Typically, a tubular housing having an inner diameter of about 1½ inch will be useful for most applications for tensioning running stock (cable, line, rope of various types) having diameters ranging from about 3/16 inch to about 1 inch.

The tubular housing has a length ranging from about 8 inches to 18 inches. Typically, a tubular housing having a length between about 10 inches to 12 inches will be satisfactory for most applications.

A hinge means is a suitable mechanism for joining the tubular housing halves together along a first set of adjacent edges. A clamp means is a suitable mechanism for joining the housing halves together along the second set of adjacent edges. Alternatively, a clamping mechanism may be used to join the tubular housing halves together along both sets of adjacent edges. Hinge and clamp mechanisms suitable for practice in the present invention are known to and readily selectable by one of ordinary skill in the art. For example, a clamp means can be a simple screw-latch and catch combination, where a catch is posed proximate the adjacent edge on a first housing half, and a latch assembly is posed proximate the adjacent edge of the second housing half. When the latch assembly is engaged with the catch, the combination may be reversibly screwed together to provide for a clamping relationship between the two halves of the tubular housing.

An inner sleeve is closely received in and lines the interior surface of the tubular housing. The removable inner sleeve is comprised of two longitudinal halves, with each inner sleeve half mated to a tubular housing half. The inner sleeve has an axial bore through the length of its axis. The axial bore has a diameter ranging from about 3/16 inch to 1 inch. The axial bore provides a channel for receiving and compressing a running stock to be wound onto the drum when the stock is disposed between the halves of inner sleeve. Running stock can be cable, line or rope of various compositions, including wire rope.

The inner sleeves are fabricated from a frictional material. The material is frictional in that when the sleeve is compressed about the running stock, drag or tension is imparted to the running stock in the opposite direction of its passage through the inner sleeve. The inner sleeves are fabricated from a frictional material appropriate for the composition of the running stock. Such frictional materials include steel, brass, and ultra high molecular weight polyethylene and other materials as may be appropriate for the running stock and the tension to be imparted to it.

A fastening means fixes or holds each inner sleeve half to the interior surface of its respective tubular housing half. A variety of such fixing means are known in the art. An appropriate such fixing mean is readily selectable by the ordinary skilled artisan for practice in the present invention. For example, a suitable fixing means is a threaded fastener passing through the inner sleeve half and engaging its respective tubular housing half, or vice versa. Alternatively, a threaded fastener can pass through the inner sleeve half and the tubular housing half to engage a nut at the outer surface of the tubular housing half and fix the sleeve halves in place. As a further alternative, a detent partially closing the end of the tubular cylinder of the housing in the direction of travel of the running stock can hold the sleeve halves in place in the housing.

The present invention imparts drag or tension to the running stock by the clamping action of the housing compressing the inner sleeve halves against the running stock as the stock is drawn through the tensioning device. The clamping action of the housing is accomplished in the tensioning device by drawing the two tubular housing halves together against the inner sleeve. The drawing of the tubular housing halves together is accomplished by the combined action of a hinge means and a clamp means. The hinge means is disposed along a first set of adjacent edges of the tubular housing halves, which allows the halves to be closed to form a substantially circular cross section. The clamp means is disposed at the second set of adjacent edges of the tubular housing halves, and is used to draw housing halves together against a resistance to closure caused by the combination of a length of running stock received in the axial bore of the inner sleeve between the sleeve halves. Alternatively, clamp means may be disposed along both the first and second sets of adjacent edges and operable to provide the clamping action of the tensioning device for closing the housing halves and compressing inner sleeve halves around the running stock received in the axial bore.

An anchor means is fixed to the outer surface of the tubular housing for mounting the housing in a position against movement. Such anchors may be accomplished as anchoring rings fixed (e.g., by welding) to the outer surface of the housing. Anchoring rings may be accomplished using a section of ¾ inch i.d. schedule 40 steel pipe. The anchoring means may be fixed to one or to both of the tubular housing halves.

In use, the wire rope or cable is placed in the axial bore of the inner sleeve of the wire rope tensioning device. The housing halves are then closed around the wire rope and a compressive force is applied to the cable by tightening the housing clamp(s). The tensioning device is anchored in a suitable location, and installation of the cable onto the drum can proceed. The housing halves, hinge means and clamp(s) are disposed to compress the inner sleeve halves against the wire rope or cable received in the axial bore of the inner sleeve. The clamping action of the device causes resistance to the passage of the cable through the housing, thereby tensioning the cable as it is drawn through the housing and wound onto the drum. The inner sleeve halves are each mechanically secured to the inner surface of their respective housing halves. The inner sleeve halves are removable and replaceable. The axial bore of the inner sleeve is selected to compliment and compressibly engage the gauge of cable to be wound onto the drum.

DETAILED DESCRIPTION OF THE INVENTION

Figure 1:
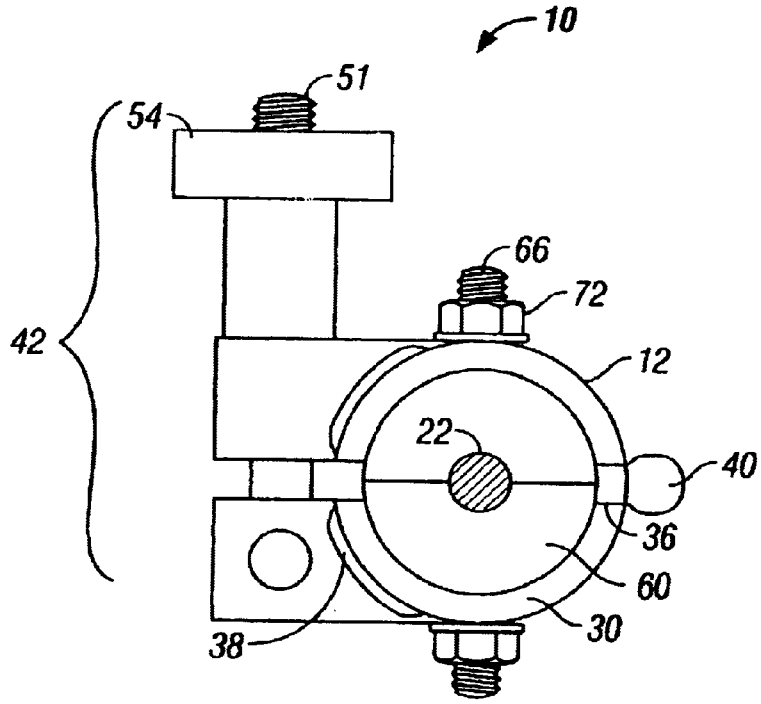
FIG. 1 is a view of an end elevation of the present wire lope tensioning device in a closed configuration and engaging a length of running stock.

In a preferred embodiment, the present invention is a device which is attachable to a wire rope for tension control associated with spooling the wire rope onto a cable drum, particularly those on cranes. The device applies a clamping drag on a running wire rope, cable or line being wound onto the drum. The wire rope tensioning device is designed to enclose a section of wire rope thereby providing tension on the wire rope, allowing the wire rope to be wound onto the drum efficiently and safely. The present device has a tubular configuration. In this preferred embodiment, the tensioning device has exchangeable inner sleeves, with a clamp means device for tightening the device on the wire rope and anchoring rings for fixing the device in place.

Referring now to the drawings, the details, of preferred embodiments of the present invention are graphically and schematically illustrated. Like elements in the drawings are represented by like numbers, and similar elements are represented by like numbers with a different lower case letter suffix.

As generally shown in the figures, the wire rope tensioning device 10 of the present invention comprises a tubular housing 12 in two longitudinal housing halves 30. The housing halves 30 contain a removable inner sleeve 16. Joining means 18 are fixed to the housing halves 30 to draw them together to compress the inner sleeve 16 between them. Anchors 80 are attached to the outer surface 32 of at least one of the tubular housing halves 30 for mounting the tensioning device 10 in a fixed position during use. In a preferred embodiment, the present device 10 is utilized to provide tension or drag on a running stock 22 that is a wire rope 22 as it is wound onto a drum or reel. However, it is clear to the ordinary skilled artisan that, based on the teaching and figures contained herein, the device may be readily adapted for applying tension or drag to a variety of running stock being wound onto a drum or reel, including cable, line and other types of rope.

Figure 2:
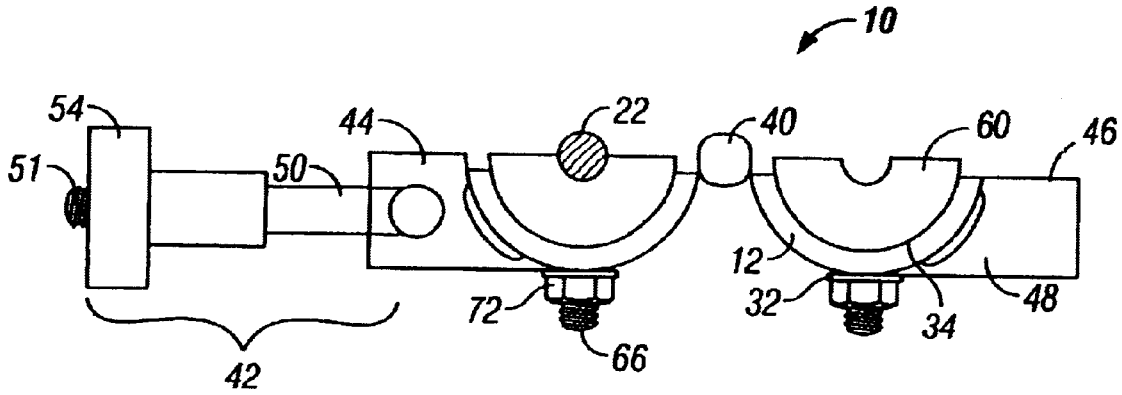
FIG. 2 is a view of an end elevation of the present wire rope tensioning device in an open configuration.

Referring now to FIGS. 1 and 2, the tubular housing 12 of the wire rope tensioning device 10 in a preferred embodiment had a cylindrical cross-section. However other cross-sectional configurations (e.g., oblong) are practicable in the device 10. The tubular housing 12 is constructed of a material suitable for its intended purpose. In the preferred embodiments shown in the figures, the housing 12 was steel. The tubular housing 12 is constructed in two longitudinal halves 30. The tubular housing halves 30, when assembled in their tubular cross-sectional configuration (as in FIG. 1), have a first set 36 and a second set 38 of adjacent edges. The joining means 18 is disposed along each set of adjacent edges 36, 38 for drawing the housing halves 30 together. In the preferred embodiment shown in the figures, the joining means 18 disposed along the first set of adjacent edges 36 is a hinge assembly or means 40, and the joining means 18 disposed along the second set of adjacent edges 38 is a clamp assembly or means 42. The combination of the hinge assembly 40 and the clamp assembly 42 provide for closing the housing halves 30 around the inner sleeve 16 and compressing it. How tightly the clamp assembly 42 is adjusted determines the amount of compression imparted to the inner sleeve 16 by the housing 12

Figure 4:
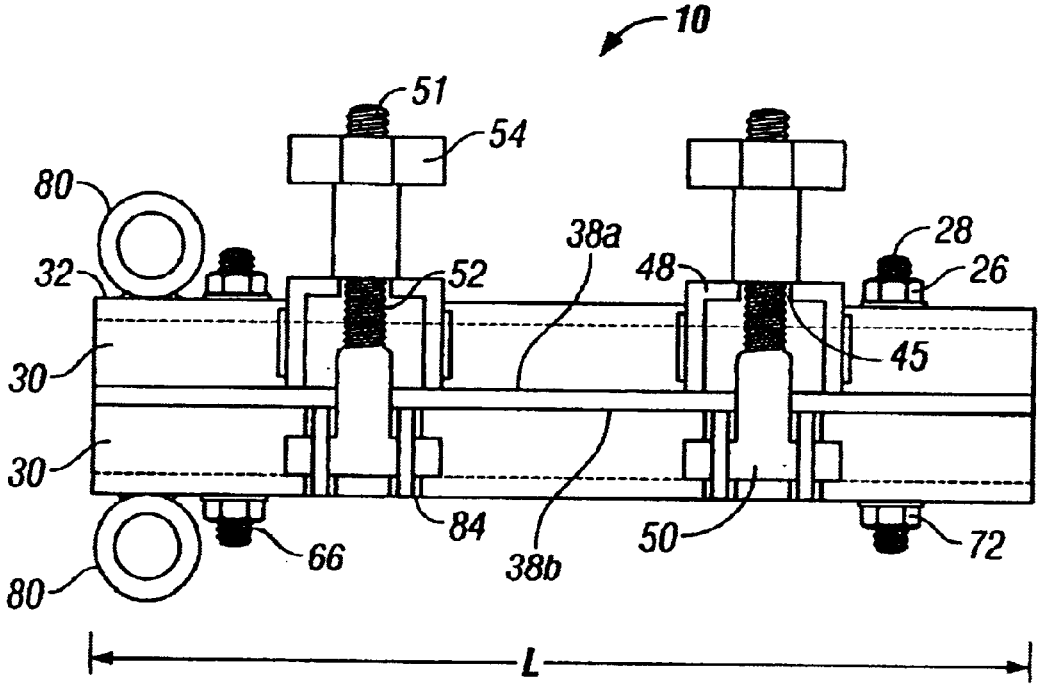
FIG. 4 is a side elevation view of the wire rope tensioning device showing the clamp means disposed proximate the adjacent edges of the tubular housing halves, and the clamp means engaged to compress the inner sleeve.
Figure 5:
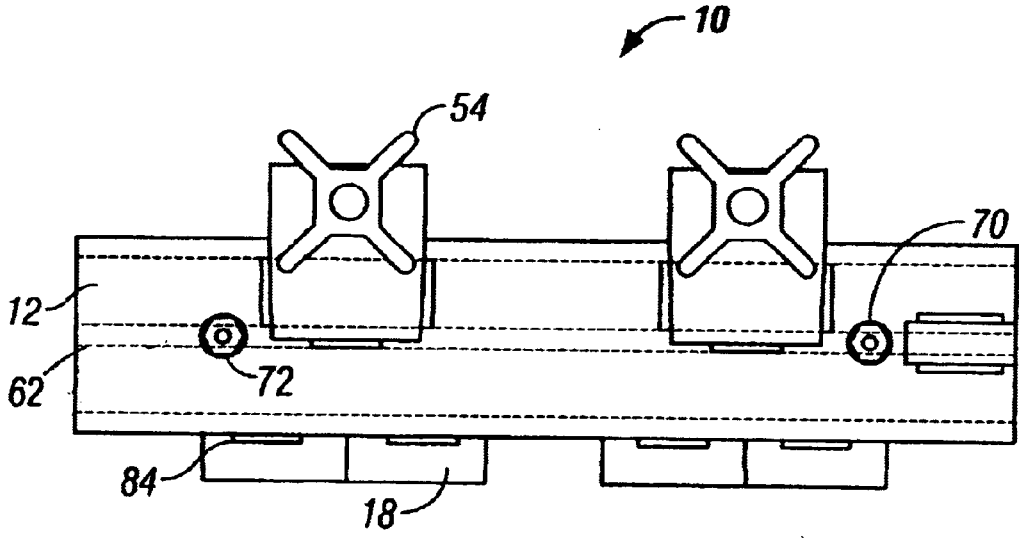
FIG. 5 is a top plan view of the wire rope tensioning device showing clamp means and a hinge means.

For most intended applications of the present invention, the housing 12 is constructed from tubing having an inner dimension ranging from about 1 to about 2 inches. In the preferred embodiment of the present invention, the tubular housing 12 was constructed from steel pipe having an inner diameter of about 1½ inches. The tubular housing 12 wire rope tensioning device 10 has a length L (see FIG. 4) ranging from about 8 inches to 18 inches. Preferably, the wire rope tensioning device 10 length L ranging from about 10 inches to 12 inches. In the preferred embodiment of FIG. 4, the housing 12 had a length of 11 inches.

In the preferred embodiment exemplified in the figures, joining means 18 for joining the housing halves 30 along the first set of adjacent edges 36 is a hinge assembly 40, and the joining means 18 for joining the housing halves 30 along the second set of adjacent edges 38 is a screw clamp assembly 42. Hinge assemblies 40 practicable in the present invention are common in the art and readily selectable by the ordinary skilled artisan. Further, attachment of the hinge assembly 40 to the tubular housing halves 30 is readily accomplishable by the skilled artisan using a number of means known in the art. In the illustrated embodiment, the hinge assembly 40 was attached to the housing halves 30 by welds 84. The hinge assembly 40 allows the housing halves 30 to be opened and closed in a clam-shell manner along a length of the tubular housing 12.

Likewise, screw clamp assemblies 42 practicable in the present invention also are common in the art and readily selectable by the ordinary skilled artisan. And, the attachment of a clamp assembly 42 to the tubular housing halves 30 also is readily accomplishable by the skilled artisan using a number of means known in the art. In the illustrated embodiment, the hinge assembly 40 was attached to the housing halves 30 by welds 84. The screw clamp assembly 42 shown in the figures comprises a catch 44 and a latch assembly 46. The catch 44 is attached to one of the second adjacent edges 38*a* by welds 84. The latch assembly 46 further comprises a latch mount 48 attached to the other of the second adjacent edges 38*b* by welds 84. A pivot pin and threaded shaft combination 50 are pivotably mounted in the latch mount 48. A threaded screw clamp head 54 is received on the threaded end 51 of the pin and shaft combination 50. When the tubular housing halves are in a closed configuration (as in FIG. 1), the mid-shaft portion 52 of the pin/shaft combination 50 is pivoted into the shaft slot 45 of the latch 48. The clamp head 54 is screwed down against the latch 48 and the clamping action of the tensioning device 10 is accomplished.

Figure 3:
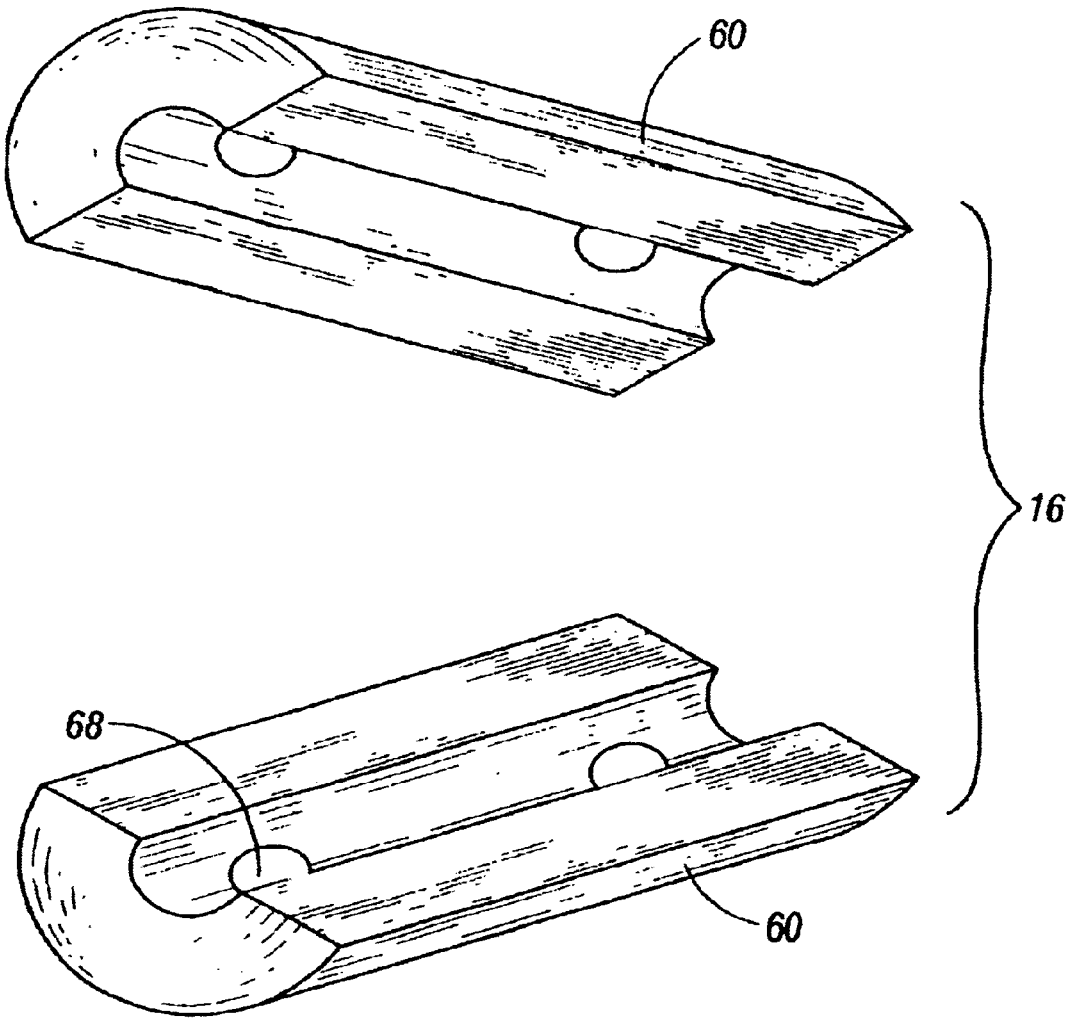
FIG. 3 is a perspective view of the halves of the inner sleeve.

As shown in FIG. 3, the removable inner sleeve 16 is constructed in two longitudinal sleeve halves 60. It is intended that the inner sleeve halves 60 be replaceable to accommodate wear and different sizes or gauges of running stock 22. Each inner sleeve half 60 is closely received in and lines the interior surface 34 of a tubular housing half 30. The inner sleeve 16 has an axial bore 62, the axial bore 62 for receiving and compressing the wire rope 22 or other running stock to be wound onto a drum, reel or the like. The cross-sectional area of the inner sleeve 16 is at least slightly larger than the cross-sectional area of the tubular housing 12, as defined by the interior surface 34 of the housing tube 12 assembled without the inner sleeve 16 contained inside it. The axial bore has a diameter ranging from about 3/16 inch to 1 inch, and the bore selected is intended to be slightly smaller than the cross-section of the running stock 22 to be received in it.

The inner sleeves halves 60 are fabricated from a frictional material that when the inner sleeve 16 is compressed about the running stock, a drag or tension is imparted to the running stock in the opposite direction of its passage through the inner sleeve 16. The inner sleeves halves 60 are fabricated from a frictional material appropriate for the composition of the running stock. Such frictional materials include steel, brass, ultra high molecular weight polyethylene and other materials as may be appropriate in view of wear considerations and the degree of drag to be imparted to the particular type of running stock.

Each inner sleeve half 60 is fixed relative to the interior surface 34 of its respective tubular housing half 30. A variety of such fixing means are known to and readily selectable by the ordinary skilled artisan for practice in the present tensioning device 10. For example, a threaded fastener 66 can pass through a sleeve aperture 68 in the inner sleeve half 60 and through a housing aperture 70 in the tubular housing half 30 to engage a nut 72 at the outer surface 32 of the tubular housing half 30 and fix the sleeve halve 60 in place. Alternatively, a threaded fastener 66 is passed through the sleeve aperture 68 in the inner sleeve half 60 and engages a threaded housing aperture 70 in its respective tubular housing half 30, or vice versa (not shown).

An anchor means 80 is fixed to the outer surface 32 of one or both of the housing halves 30 of the tubular housing 12. The anchor means 80 provides for mounting the housing 12 in position to prevent its movement relative to the drum or reel onto which the running stock 22 is being wound. Anchors 80 may be rings fixed (e.g., by welding) to the outer surface 32 of the housing 12. Anchoring rings 80 may be accomplished using a section of ¾ inch i.d. schedule 40 steel pipe. Preferably, the present tensioning device comprises more than one anchor means 80. As shown in the preferred embodiment of FIG. 4, the anchor means 80 were fixed at least one to each housing half 30, such that when the housing halves 30 were closed, the anchoring means were in the same plane or parallel to each other.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A wire rope tensioning device comprising:

a tubular housing in two longitudinal halves; the tubular housing halves having a first set of adjacent edges and a second set of adjacent edges; and a means for joining the housing halves along each set of adjacent edges;

a removable inner sleeve in two longitudinal halves, each sleeve half closely received in and lining an interior surface of a tubular housing half, the inner sleeve having an axial bore, the axial bore for receiving and slideably compressing the wire rope to be wound onto a drum;

a clamp means disposed along the second adjacent edges for closing the housing halves and compressing inner sleeve halves around the wire rope received in the axial bore; and a plurality of anchoring rings, mounted on the tubular housing for fixing the housing against movement.

2. The wire rope tensioning device of claim 1, wherein the tubular housing is constructed from steel tubing.

3. The wire rope tensioning device of claim 1, wherein the tubular housing is constructed from steel tubing, having an inner diameter ranging from about 1 inch to about 2 inches.

4. The wire rope tensioning device of claim 1, wherein the tubular housing is constructed from steel tubing, having an inner diameter of about 1½ inch.

5. The wire rope tensioning device of claim 1, wherein the tubular housing has a length, ranging from about 8 inches to 18 inches.

6. The wire rope tensioning device of claim 1, wherein the tubular housing has a length, ranging from about 10 inches to 12 inches.

7. The wire rope tensioning device of claim 1, wherein the tubular housing has a length, about 11 inches.

8. The wire rope tensioning device of claim 1, wherein the means for joining the housing halves along the first set of adjacent edges is a hinge means.

9. The wire rope tensioning device of claim 1, wherein the clamp means comprises a catch disposed proximate the second adjacent edge on a first housing half, and a latch assembly disposed proximate the second adjacent edge of the a second housing half, the latch assembly for closeably engaging the catch.

10. The wire rope tensioning device of claim 1, wherein the inner sleeves are fabricated from a frictional material.

11. The wire rope tensioning device of claim 1, wherein the inner sleeves are fabricated from a frictional material consisting of steel, brass, or ultra high molecular weight polyethylene.

12. The wire rope tensioning device of claim 1, wherein the axial bore has a diameter ranging from about 3/16 inch to 1 inch.

13. The wire rope tensioning device of claim 1, further comprising a fastening means for fixing each inner sleeve half to the interior surface of each tubular housing half.

14. The wire rope tensioning device of claim 13, wherein the fixing means is a threaded fastener passing through the inner sleeve half and engaging the tubular housing half.

15. The wire rope tensioning device of claim 13, wherein the fixing means is a threaded fastener passing through the inner sleeve half and the tubular housing half and engaging a nut at an outer surface of the tubular housing half.

16. The wire rope tensioning device of claim 1, wherein the anchoring rings comprise a section of ¾ inch inner diameter schedule 40 pipe.

17. The wire rope tensioning device of claim 1, wherein at least one anchor ring is fixed to each housing half.

18. The wire rope tensioning device of claim 1, wherein at least one anchor ring is fixed to each housing half, such that when the housing halves are closed, the anchoring rings are parallel to each other.

* * * * *